US009695523B2

(12) United States Patent
Dardona et al.

(10) Patent No.: US 9,695,523 B2
(45) Date of Patent: Jul. 4, 2017

(54) CONTROLLED TRIVALENT CHROMIUM PRETREATMENT

(71) Applicant: Hamilton Sundstrand Corporation, Windsor Locks, CT (US)

(72) Inventors: Sameh Dardona, South Windsor, CT (US); Mark R. Jaworowski, Glastonbury, CT (US); Sergei F. Burlatsky, West Hartford, CT (US); Dmitri Novikov, Avon, CT (US); Lei Chen, South Windsor, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 936 days.

(21) Appl. No.: 14/052,719

(22) Filed: Oct. 12, 2013

(65) Prior Publication Data

US 2015/0101934 A1 Apr. 16, 2015

(51) Int. Cl.

| | |
|---|---|
| ***C25D 9/04*** | (2006.01) |
| ***C25D 3/06*** | (2006.01) |
| ***C25D 5/18*** | (2006.01) |
| ***C25D 21/12*** | (2006.01) |
| ***C25D 9/06*** | (2006.01) |

(52) U.S. Cl.

CPC ..... *C25D 3/06* (2013.01); *C25D 5/18* (2013.01); *C25D 9/04* (2013.01); *C25D 9/06* (2013.01); *C25D 21/12* (2013.01)

(58) Field of Classification Search

CPC ..... C25D 9/04; C25D 3/06

See application file for complete search history.

(56) References Cited

U.S. PATENT DOCUMENTS

| | | | | |
|---|---|---|---|---|
| 4,137,132 | A * | 1/1979 | Ward | C25D 9/08 148/255 |
| 5,147,729 | A | 9/1992 | Ogishi et al. | |
| 5,820,741 | A * | 10/1998 | Bibber | C25D 11/38 205/287 |
| 6,004,448 | A * | 12/1999 | Martyak | C25D 9/08 205/178 |
| 7,101,469 | B2 | 9/2006 | Kochilla et al. | |

OTHER PUBLICATIONS

"An X-Ray Absorption Near-Edge Spectroscopy Study of the Oxidation State of Chromium in Electrodeposition Oxide Films" by Balasubramanian et al., Electrochimica Acta 44(17), pp. 2941-2945 (1999).*

* cited by examiner

*Primary Examiner* — Bryan D. Ripa

(74) *Attorney, Agent, or Firm* — Kinney & Lange, P.A.

(57) ABSTRACT

A method for forming a trivalent chromium coating on an aluminum alloy substrate includes adding a chromium-containing solution to a vessel, immersing the aluminum alloy substrate in the chromium-containing solution, immersing a counter electrode in the chromium-containing solution, and applying an electrical potential bias to the aluminum alloy substrate with respect to its equilibrium potential to form a trivalent chromium coating on an outer surface of the aluminum alloy substrate. A method for forming a trivalent chromium coating on a metal substrate includes adding a chromium-containing solution to a vessel, immersing the metal substrate in the chromium-containing solution, immersing a counter electrode in the chromium-containing solution, and modulating an electrical potential difference between the metal substrate and the counter electrode to form a trivalent chromium coating on an outer surface of the metal substrate.

14 Claims, 4 Drawing Sheets

CONTROLLED TRIVALENT CHROMIUM PRETREATMENT

BACKGROUND

Metal surface protection is important for a variety of applications including aircraft structural components, heat exchangers and electrical system housings. A number of coating approaches have been taken to protect metal surfaces. Chromate conversion coatings are sometimes used to replace native oxide films on metal surfaces because they possess desirable and predictable properties. For example, chromate conversion coatings offer active corrosion protection and promote adhesion of other coatings to aluminum alloys. However, the presence of hexavalent chromium, a carcinogen, in these coatings discourages their continued use.

One alternative to conversion coatings containing hexavalent chromium is trivalent chromium pretreatment (TCP). One such example has been developed by the U.S. Navy and is described in U.S. Pat. No. 6,375,726. This TCP process has seen use in automotive and architectural applications. However, the use of TCP coatings in aerospace applications is problematic due to base alloy properties and process sensitivities that yield inconsistent and short-duration passivity of treated metal surfaces. In conventional TCP processes, a metal substrate is dipped into a TCP solution for a specified length of time (generally 5 minutes or more). The chemical reactions in the TCP process are driven by the electrochemical potential of the metal substrate. For alloy systems, microscopic variations in the substrate's electrochemical potential exist due to micro scale intermetallic particles (precipitates that exist on the alloy surface). As a result, the conventional TCP process is difficult to control and unpredictable and does not produce a robust coating. TCP coating failures for alloys have been attributed to nonuniformity in the chemical composition across the intermetallic particles (IMs), which is believed to be due to diffusional mass transportation limitations of the chromium coating formed on the intermetallic particles.

SUMMARY

A method for forming a trivalent chromium coating on an aluminum alloy substrate includes adding a chromium-containing solution to a vessel, immersing the aluminum alloy substrate in the chromium-containing solution, immersing a counter electrode in the chromium-containing solution, and applying an electrical potential bias to the aluminum alloy substrate with respect to its equilibrium potential to form a trivalent chromium coating on an outer surface of the aluminum alloy substrate.

A method for forming a trivalent chromium coating on a metal substrate includes adding a chromium-containing solution to a vessel, immersing the metal substrate in the chromium-containing solution, immersing a counter electrode in the chromium-containing solution, and modulating an electrical potential difference between the metal substrate and the counter electrode to form a trivalent chromium coating on an outer surface of the metal substrate.

DETAILED DESCRIPTION

The present invention provides a potential controlled trivalent chromium pretreatment (TCP) coating process. An electric potential difference is created to apply a TCP coating reproducibly and consistently to a metal substrate. A modulated waveform can be used to control various characteristics of the TCP coating. TCP coatings applied to a metal substrate using the potential controlled method described herein exhibit improved surface structure, surface adhesion characteristics and/or corrosion resistance.

Figure 1:
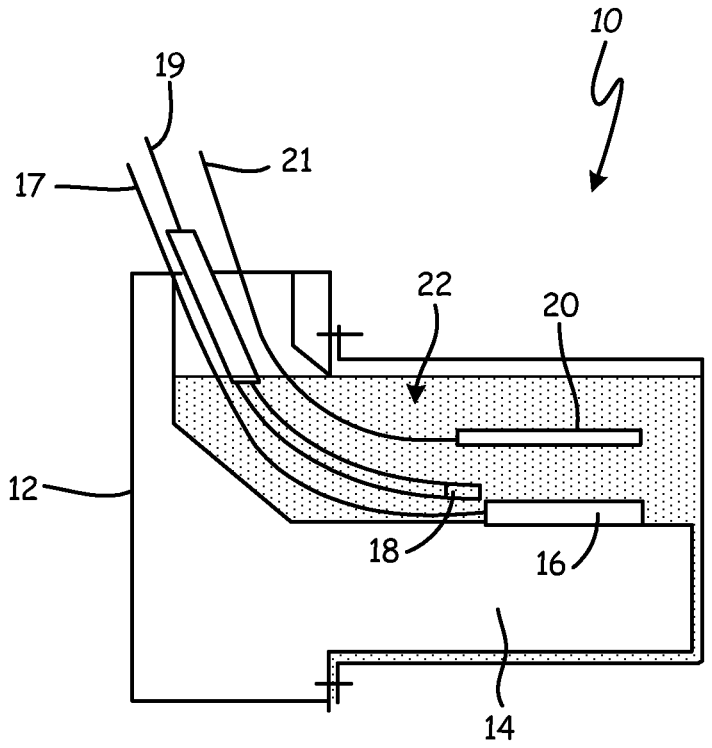
FIG. 1 is a schematic view of a system for applying a TCP coating according to one embodiment of the present invention.

FIG. 1 illustrates a schematic view of one embodiment of a system for applying a trivalent chromium coating (TCP coating). TCP coating system 10 includes tank 12, base 14, substrate 16, and electrodes 18 and 20. Tank 12 is a vessel for carrying out the TCP coating steps described herein. Tank 12 is configured to contain the chromium-containing solution used for forming the TCP coating, the substrate to be coated and components necessary to form an electrochemical cell. In some embodiments, the sides and/or bottom of tank 12 are glass. Base 14 is positioned within tank 12 and serves to support substrate 16 within tank 12. Base 14 is a neutral structure within tank 12 and is not significantly involved in the electrochemical reactions occurring in tank 12. In some embodiments, base 14 is polytetrafluoroethylene (PTFE). Tank 12 is configured to hold a chromium-containing solution. As shown in FIG. 1, chromium-containing solution 22 is present within tank 12 and contained by the sides of tank 12 and base 14. TCP coating system 10 can also include a spectroscopic ellipsometer to measure the substrate's oxide etching, as well as the thickness and composition of the TCP coating as it is deposited on a substrate. Based on the spectroscopic ellipsometry results, the electrical potential difference and duration can be modified during the coating process in order to produce a TCP coating suitable for the substrate.

Substrate 16 is positioned within tank 12 on base 14 in this example. Electrodes 18 and 20 are positioned within tank 12 so that electrodes 18 and 20 contact chromium-containing solution 22. Together, substrate 16, electrodes 18 and 20 and chromium-containing solution 22 form an electrochemical cell. Substrate 16 serves as the working electrode within the cell, electrode 18 serves as the reference electrode, electrode 20 serves as the counter electrode and chromium-containing solution 22 serves as the electrolyte. Substrate 16, reference electrode 18 and counter electrode 20 are connected to respective working, reference and counter leads. As shown in FIG. 1A, working lead 17 is connected to substrate 16, reference lead 19 is connected to reference electrode 18, and counter lead 21 is connected to counter electrode 20. As described herein in greater detail, an electrical potential difference is created within the electrochemical cell to form a TCP coating on exposed outer surfaces of substrate 16.

Substrate 16 is a metal or metal alloy. In one embodiment, substrate 16 is aluminum. In other embodiments, substrate 16 is an aluminum alloy. While any aluminum alloy can benefit from the TCP coating method described herein, exemplary aluminum alloys include, but are not limited to, 2000 series and 7000 series alloys as classified by the International Alloy Designation System. 2000 series alloys typically include significant amounts of copper, and 7000 series alloys typically include significant amounts of zinc. Where substrate 16 is a metal alloy, the surface of substrate 16 contains bulk alloy compounds as well as intermetallic particles (IMs). For the purposes of this application, intermetallic particles refer to non-alloy precipitate phases that form when the alloy solidifies. Intermetallic particles behave differently than the bulk material of the substrate and are believed to contribute to the unpredictability observed when conventional TCP coating methods are used on metal alloys. For example, aluminum alloy surfaces may include intermetallic particles that contain copper. The chromium content of a conventionally-formed TCP conversion coating is lower in the vicinity of the copper intermetallic particles than it is on the rest of the aluminum alloy surface.

Electrode 18 is a reference electrode. In some embodiments, reference electrode 18 is an Ag/AgCl reference electrode. In other embodiments, reference electrode 18 is a standard hydrogen electrode (SHE). Electrode 20 is a counter electrode. In some embodiments, counter electrode 20 contains platinum. In other embodiments, counter electrode 20 contains high density graphite. In one embodiment, counter electrode 20 is platinum foil.

Chromium-containing solution 22 is an aqueous solution that contains trivalent chromium as substantially the only chromium ion present. The trivalent chromium present in chromium-containing solution 22 can be derived from a number of sources that include, but are not limited to, chromium (III) sulfate, chromium (III) chloride, chromium (III) acetate, and chromium (III) nitrate. Chromium-containing solution 22 also generally contains zirconium ions. Chromium-containing solution 22 is generally acidic. In some embodiments, chromium-containing solution 22 has a pH between about 3 and about 4. In one embodiment, chromium-containing solution 22 has a pH between about 3.6 and about 3.9. The acidity of chromium-containing solution 22 can be adjusted and maintained at the desired pH during coating using inorganic acids, such as nitric acid, hydrochloric acid, sulfuric acid, etc.

According to conventional TCP coating methods, a substrate is dipped into a chromium-containing solution or the TCP coating is sprayed or brushed onto the substrate to deposit a TCP coating on the substrate. According to the present invention, substrate 16 is immersed in chromium-containing solution 22 within tank 12 and an electrical potential difference is created within the formed electrochemical cell to control the coating process. For the purposes of this patent application, the electrical potential difference reported is with respect to a standard hydrogen reference electrode 18 (SHE).

The TCP coating applied to substrate 16 can be tuned by controlling the electrical potential difference within tank 12. The growth rate and the surface chemistry of the coating can be controlled by application of an electrical potential difference (bias) to substrate 16 with respect to its equilibrium potential. In one embodiment of the present invention, TCP coating is performed by direct potentiostatic control of the cell. In potentiostatic mode, the potential of counter electrode 20 against the working electrode (substrate 16) is accurately controlled so that the potential difference between the substrate 16 and reference electrode 18 is well defined, and corresponds to a value specified by the user. In other embodiments, galvanostatic cell control is used. In this mode, current flow between substrate 16 and counter electrode 20 is controlled. The potential difference between reference electrode 18 and substrate 16 is monitored and adjusted to maintain the desired current flow between substrate 16 and counter electrode 20.

For example, anodic sample polarization (a more noble potential, $V_{max}$) promotes dissolution of aluminum on the surface of substrate 16 and suppresses hydrogen evolution. This allows $Al^{3+}$ ions to diffuse over any intermetallic particles present on the surface of substrate 16. This diffusion of aluminum ions provides a more uniform outer surface with fewer intermetallic particles. Fewer intermetallic particles at the surface are then available to disrupt further steps in the TCP coating process, allowing the process to yield a more reproducible coating on the surface of substrate 16. Aluminum ions at the surface of substrate 16 are also able to trigger precipitation of additives such as $ZrO_2$ or $TiO_2$ through fluoride abstraction, causing deposition of the additives on the surface of substrate 16. The presence of zirconium in the TCP coating improves the surface structure and increases adhesive strength.

On the other hand, cathodic sample polarization (a more active potential, $V_{min}$) results in hydrolysis-based reactions at the substrate surface. These reactions include the deposition of $Cr(OH)_3$ due to the creation of surface alkalinity and the relatively low rate of aluminum oxidation present on the surface of substrate 16. The presence of chromium in the TCP coating improves corrosion resistance. The degree of cathodic sample polarization also affects the TCP coating process. For example, at high negative potential, the amount of chromium in the TCP coating increases while the amount of zirconium decreases. Generally speaking, the higher the chromium content of a TCP coating, the greater the corrosion inhibition.

Using anodic sample polarization or cathodic sample polarization, the TCP coating formed on substrate 16 can be controlled and tuned to suit the specific needs of substrate 16. For instance, where corrosion inhibition is critical, a more negative potential is created to promote chromium deposition. Alternatively, where surface structure and/or adhesion potential is more important, a lesser negative or positive potential is created to promote a higher degree of zirconium deposition. In some embodiments where an unmodulated electrical potential difference is used to carry out the TCP coating process, the electrical potential difference is between about −0.1 V and about −1.6 V.

Figure 2:
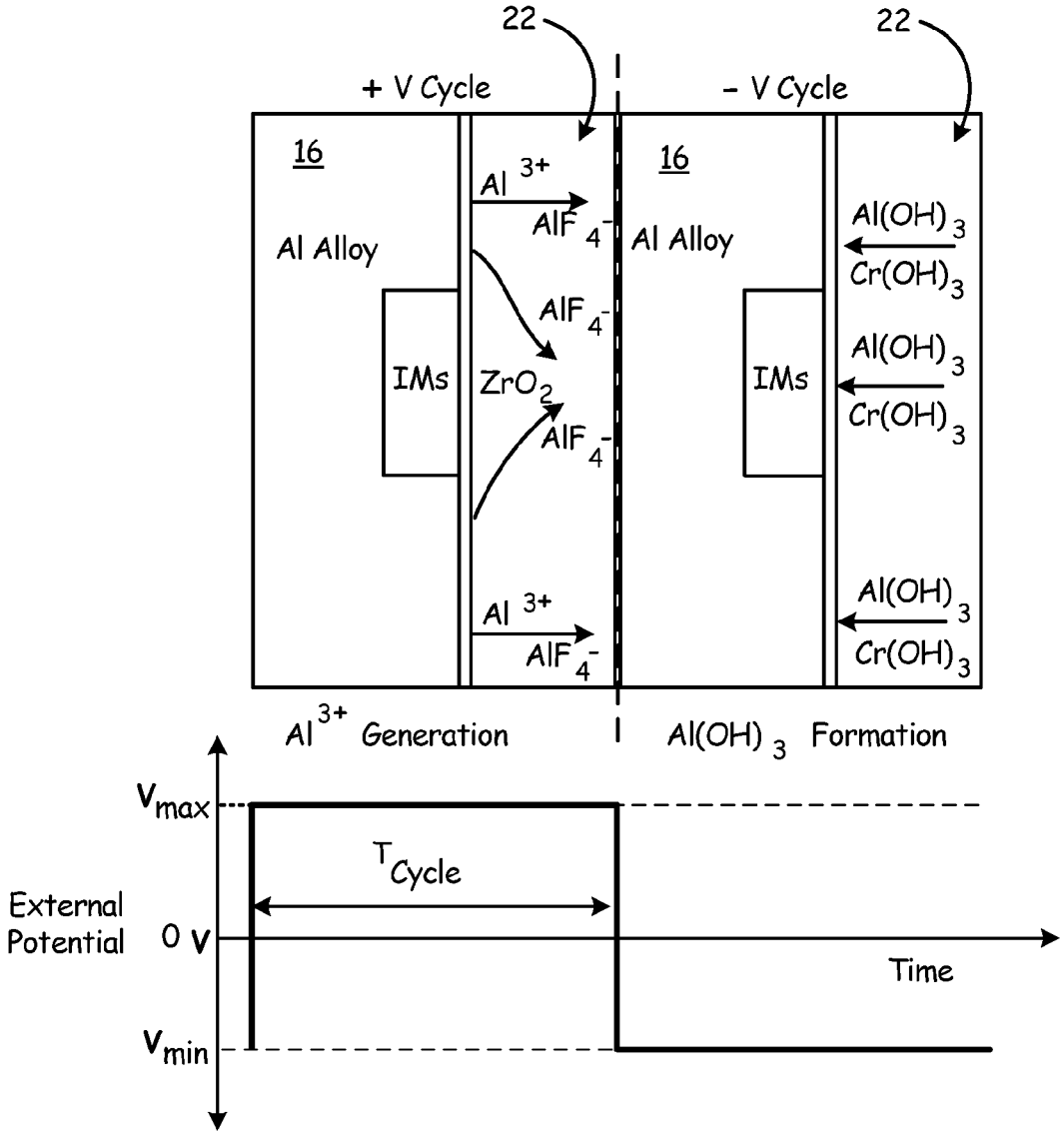
FIG. 2 is a schematic and accompanying graph illustrating the effects of anodic sample polarization ($V_{max}$) and cathodic sample polarization ($V_{min}$) on chemical reactions governing TCP film formation.

In other embodiments, the electrical potential difference in the electrochemical cell between substrate 16 and counter electrode 20 is modulated between anodic sample polarization and cathodic sample polarization. FIG. 2 shows a schematic view of substrate 16 and illustrates the effects of modulated anodic sample polarization ($V_{max}$) and cathodic sample polarization ($V_{min}$). As noted above, aluminum dissolution and zirconium deposition, for example, occur during anodic sample polarization and chromium deposition occurs during cathodic sample polarization.

By varying the degree of sample polarization and the time spent at anodic sample polarization and cathodic sample polarization, additional control and tuning of TCP coating characteristics is obtainable. In some embodiments where a modulated electrical potential difference is used to carry out the TCP coating process, the electrical potential difference between substrate 16 and counter electrode 20 during anodic sample polarization is between about 0 V and about 0.6 V.

In some embodiments, the electrical potential difference during cathodic sample polarization is between about −0.8 V and about −1.8 V.

Figure 3A:
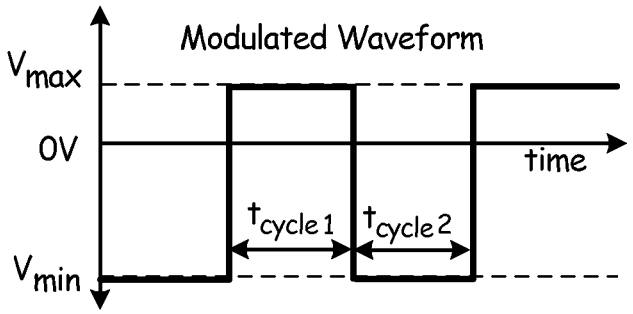
FIGS. 3A-3C are graphs illustrating different modulated DC waveforms applied during a controlled TCP process according to the present invention.
Figure 3B:
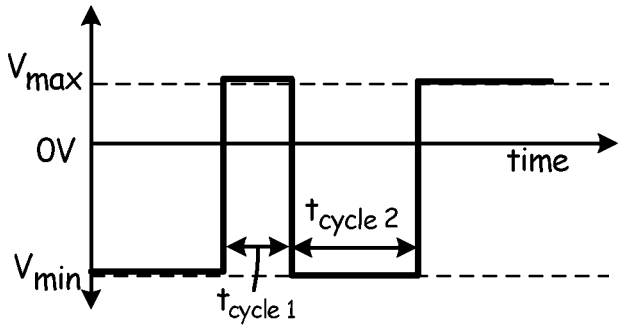
Figure 3C:
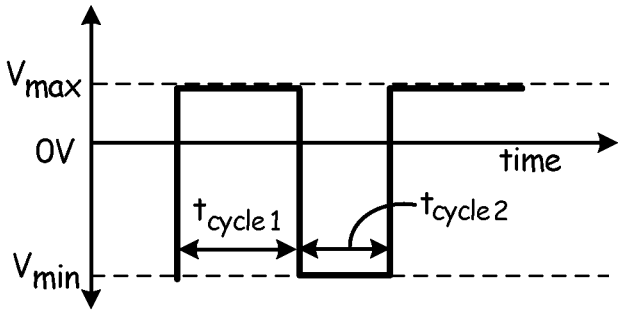

FIGS. 3A-3C show graphs illustrating different waveforms of modulated electrical potential differences applied during a controlled TCP process. The waveforms show the relative magnitude of anodic and cathodic sample polarization and the relative amount of time at each condition. Generally, $V_{max}$ refers to the anodic sample polarization condition while $V_{min}$ refers to the cathodic sample polarization condition, and $t_{cycle1}$ refers to the exposure time for anodic sample polarization while $t_{cycle2}$ refers to the exposure time for cathodic sample polarization. The waveforms represented in FIGS. 3A-3C are meant to be repeated until the TCP coating operation is complete. Typically, the difference between $V_{max}$ and $V_{min}$ is less than about 1.5 V to prevent water electrolysis within TCP coating system 10. While FIGS. 3A-3C illustrate square waveforms, other waveform shapes (such as sinusoidal, triangular and sawtooth waveforms) are possible and within the scope of the present invention.

FIG. 3A illustrates a waveform in which the potential difference is generally equally split between $V_{max}$ and $V_{min}$ (i.e. the substrate is exposed to $V_{max}$ and $V_{min}$ for generally equal amounts of time). Equal time spent at anodic sample polarization and cathodic sample polarization conditions promotes aluminum dissolution and zirconium deposition and chromium deposition relatively equally. FIG. 3B illustrates a waveform in which the substrate is exposed to the $V_{min}$ condition for a longer period of time than the $V_{max}$ condition. The increased time at the cathodic sample polarization condition ($V_{min}$) promotes chromium deposition more than aluminum dissolution and zirconium deposition. FIG. 3C illustrates a waveform in which the substrate is exposed to the $V_{max}$ condition for a longer period of time than the $V_{min}$ condition. The increased time at the anodic sample polarization condition ($V_{max}$) promotes aluminum dissolution and zirconium deposition more than chromium deposition.

Figure 4:
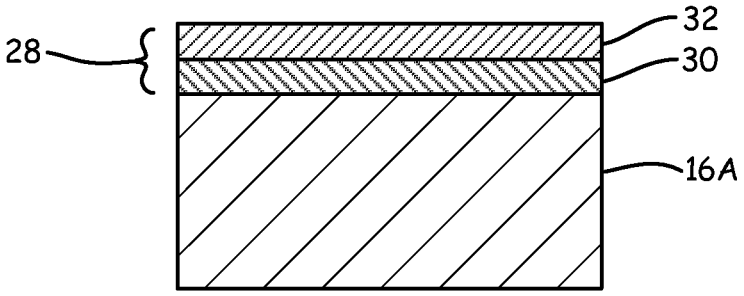
FIG. 4 is a schematic illustration of an alloy substrate with a duplex conversion coating.

By varying the values for $V_{max}$, $V_{min}$, $t_{cycle1}$ and $t_{cycle2}$, the characteristics of the TCP coating formed on substrate 16 can be controlled. For example, in one particular embodiment a barrier layer is sandwiched between an aluminum alloy substrate and a top corrosion-inhibiting layer. FIG. 4 shows a schematic illustration of aluminum alloy substrate 16A with a duplex conversion coating 28 (barrier layer 30 and corrosion resistant layer 32). Duplex conversion coating 28 is formed on substrate 16A using a programed waveform profile in which a short $t_{cycle2}$/long $t_{cycle1}$ cycle is used at the beginning of the deposition process and a long $t_{cycle2}$/short $t_{cycle1}$ cycle is used at the end of the deposition process. As a result, barrier layer 30 includes higher levels of zirconium than corrosion resistant layer 32, while corrosion resistant layer 32 contains higher levels of chromium than barrier layer 30. The dissolution of aluminum ions across the intermetallic particles of substrate 16A during the short $t_{cycle2}$/long $t_{cycle1}$ cycle reduces the effects the intermetallic particles have on the later long $t_{cycle2}$/short $t_{cycle1}$ cycle. The presence of barrier layer 30 creates a more uniform surface (fewer surface intermetallic particles) for receiving corrosion resistant layer 32.

Figure 5:
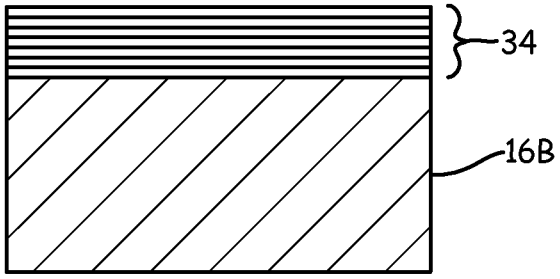
FIG. 5 is a schematic illustration of a substrate with a laminate conversion coating.

FIG. 5 shows a schematic illustration of a substrate with a laminate conversion coating. Multiple layers of TCP coating can be applied to substrate 16B using the method described herein. The electrical potential difference is changed for each layer of laminate conversion coating 34. The various layers of laminate conversion coating 34 can be tuned to contain varying amounts of aluminum ions, zirconium and chromium based on the electrical potential difference.

In some embodiments of the TCP coating process described herein, real-time monitoring of the coating process is performed. Total electrochemical current collected at the counter electrode originated from the substrate surface and indicates changes in surface chemistry (such as native oxide dissolution) as well as TCP film thickness. Additionally, in situ spectroscopic ellipsometry using light source 24 and detector (spectroscopic ellipsometer) 26 can be performed to monitor the coating process.

The coating process described herein provides a TCP coating on a metal substrate that exhibits improved corrosion inhibition compared to convention TCP coating methods. The described TCP coating process is reproducible, avoids the use of hexavalent chromium, and offers greater control over the composition of the TCP coating.

Discussion of Possible Embodiments

The following are non-exclusive descriptions of possible embodiments of the present invention.

A method for forming a trivalent chromium coating on an aluminum alloy substrate can include adding a chromium-containing solution to a vessel, immersing the aluminum alloy substrate in the chromium-containing solution, immersing a counter electrode in the chromium-containing solution, and applying an electrical potential bias to the aluminum alloy substrate with respect to its equilibrium potential to form a trivalent chromium coating on an outer surface of the aluminum alloy substrate.

The method of the preceding paragraph can optionally include, additionally and/or alternatively, any one or more of the following features, configurations and/or additional components:

A further embodiment of the foregoing method can further include that the electrical potential bias is between about −0.1 V and about −1.3 V with respect to a standard hydrogen electrode (SHE) to promote dissolution of $Al^{3+}$ ions from the outer surface of the aluminum alloy substrate and promote deposition of $ZrO_2$ or $TiO_2$ on the outer surface of the aluminum alloy substrate.

A further embodiment of any of the foregoing methods can further include that the electrical potential bias is between about −1.3 V and about −1.6 V with respect to a SHE to promote deposition of $Cr(OH)_3$ on the outer surface of the aluminum alloy substrate.

A further embodiment of any of the foregoing methods can further include that the electrical potential bias is modulated between a positive value and a negative value relative to the equilibrium potential of the aluminum alloy substrate.

A further embodiment of any of the foregoing methods can further include that the electrical potential bias is at the positive value for a period of time longer than the negative value to promote dissolution of $Al^{3+}$ ions from the outer surface of the aluminum alloy substrate and promote deposition of $ZrO_2$ or $TiO_2$ on the outer surface of the aluminum alloy substrate.

A further embodiment of any of the foregoing methods can further include that the electrical potential bias is between about 0 V and about 0.6 V at the positive value.

A further embodiment of any of the foregoing methods can further include that the electrical potential bias is at the negative value for a period of time longer than the positive value to promote deposition of $Cr(OH)_3$ on the outer surface of the aluminum alloy substrate.

A further embodiment of any of the foregoing methods can further include that the electrical potential bias is between about −0.8 V and about −1.8 V at the negative value.

A further embodiment of any of the foregoing methods can further include that a difference between the positive value and the negative value is less than about 1.5 V.

A further embodiment of any of the foregoing methods can further include that the chromium-containing solution is maintained at a pH between about 3.6 and about 3.9 while the electrical potential bias is maintained.

A further embodiment of any of the foregoing methods can further include monitoring formation of the trivalent chromium coating using in situ spectroscopic ellipsometry and modulating the electrical potential bias between the positive value and the negative value depending on results obtained from the spectroscopic ellipsometry.

A method for forming a trivalent chromium coating on a metal substrate can include adding a chromium-containing solution to a vessel, immersing the metal substrate in the chromium-containing solution, immersing a counter electrode in the chromium-containing solution, and modulating an electrical potential difference between the metal substrate and the counter electrode to form a trivalent chromium coating on an outer surface of the metal substrate.

The method of the preceding paragraph can optionally include, additionally and/or alternatively, any one or more of the following features, configurations and/or additional components:

A further embodiment of the foregoing method can further include that the electrical potential difference varies between a positive value and a negative value.

A further embodiment of any of the foregoing methods can further include that the electrical potential difference with respect to the metal substrate is at the positive value for a period of time longer than the negative value to promote dissolution of $Al^{3+}$ ions from the outer surface of the aluminum alloy substrate and promote deposition of $ZrO_2$ or $TiO_2$ on the outer surface of the aluminum alloy substrate.

A further embodiment of any of the foregoing methods can further include that the electrical potential difference with respect to the metal substrate is at the negative value for a period of time longer than the positive value to promote deposition of $Cr(OH)_3$ on the outer surface of the aluminum alloy substrate.

Although the present invention has been described with reference to preferred embodiments, workers skilled in the art will recognize that changes may be made in form and detail without departing from the spirit and scope of the invention.

The invention claimed is:

1. A method for forming a trivalent chromium coating on an aluminum alloy substrate, the method comprising:

adding a chromium-containing solution to a vessel;

immersing the aluminum alloy substrate in the chromium-containing solution;

immersing a counter electrode in the chromium-containing solution; and applying an electrical potential bias to the aluminum alloy substrate with respect to its equilibrium potential to form a trivalent chromium coating on an outer surface of the aluminum alloy substrate, wherein the electrical potential bias is modulated between a positive value and a negative value relative to the equilibrium potential of the aluminum alloy substrate.

2. The method of claim 1, wherein the chromium-containing solution comprises $ZrO_2$ or $TiO_2$ and wherein the electrical potential bias is at the positive value for a period of time longer than the negative value to promote dissolution of $Al^{3+}$ ions from the outer surface of the aluminum alloy substrate and promote deposition of $ZrO_2$ or $TiO_2$ on the outer surface of the aluminum alloy substrate.

3. The method of claim 2, wherein the electrical potential bias is between about 0 V and about 0.6 V with respect to a SHE at the positive value.

4. The method of claim 1, wherein the electrical potential bias is at the negative value for a period of time longer than the positive value to promote deposition of $Cr(OH)_3$ on the outer surface of the aluminum alloy substrate.

5. The method of claim 4, wherein the electrical potential bias is between about −0.8 V and about −1.8 V with respect to a SHE at the negative value.

6. The method of claim 1, wherein a difference between the positive value and the negative value is less than about 1.5 V with respect to a SHE.

7. The method of claim 1, wherein the chromium-containing solution is maintained at a pH between about 3.6 and about 3.9 while the electrical potential bias is maintained.

8. The method of claim 1, further comprising:

monitoring formation of the trivalent chromium coating using in situ spectroscopic ellipsometry; and modulating the electrical potential bias between the positive value and the negative value depending on results obtained from the spectroscopic ellipsometry.

9. A method for forming a trivalent chromium coating on a metal substrate, the method comprising:

adding a chromium-containing solution to a vessel;

immersing the metal substrate in the chromium-containing solution;

immersing a counter electrode in the chromium-containing solution; and modulating an electrical potential difference between the metal substrate and the counter electrode to form a trivalent chromium coating on an outer surface of the metal substrate, wherein the electrical potential difference varies between a positive value and a negative value.

10. The method of claim 9, wherein the metal substrate comprises aluminum, wherein the chromium-containing solution comprises $ZrO_2$ or $TiO_2$ and wherein the electrical potential difference with respect to the metal substrate is at the positive value for a period of time longer than the negative value to promote dissolution of $Al^{3+}$ ions from the outer surface of the metal substrate and promote deposition of $ZrO_2$ or $TiO_2$ on the outer surface of the metal substrate.

11. The method of claim 9, wherein the electrical potential difference with respect to the metal substrate is at the negative value for a period of time longer than the positive value to promote deposition of $Cr(OH)_3$ on the outer surface of the metal substrate.

12. A method for forming a trivalent chromium coating on an aluminum alloy substrate, the method comprising:

adding a chromium-containing solution to a vessel, the chromium-containing solution comprising $ZrO_2$ or $TiO_2$;

immersing the aluminum alloy substrate in the chromium-containing solution;

immersing a counter electrode in the chromium-containing solution; and applying an electrical potential bias to the aluminum alloy substrate with respect to its equilibrium potential to form a trivalent chromium coating on an outer surface of the aluminum alloy substrate, wherein the electrical potential bias is between about −0.1 V and about −1.6 V with respect to a standard hydrogen electrode (SHE).

13. The method of claim 12, wherein the electrical potential bias is between about −0.1 V and about −1.3 V with respect to a standard hydrogen electrode (SHE) to promote dissolution of $Al^{3+}$ ions from the outer surface of the aluminum alloy substrate and promote deposition of $ZrO_2$ or $TiO_2$ on the outer surface of the aluminum alloy substrate.

14. The method of claim 12, wherein the electrical potential bias is between about −1.3 V and about −1.6 V with respect to a SHE to promote deposition of $Cr(OH)_3$ on the outer surface of the aluminum alloy substrate.

* * * * *